US005295270A

United States Patent [19]

Phillips et al.

[11] Patent Number: 5,295,270

[45] Date of Patent: Mar. 22, 1994

[54] NECKTIE WITH PRE-FORMED KNOT

[75] Inventors: Jane Phillips, 2160 Canyon Lakes Dr., San Ramon, Calif. 94583; Judy Perchonock, Oakland, Calif.

[73] Assignee: Jane Phillips, San Ramon, Calif.

[21] Appl. No.: 987,646

[22] Filed: Dec. 9, 1992

[51] Int. Cl.[5] ..... A41D 25/02; A41D 25/16

[52] U.S. Cl. ..... 2/150; 2/144; 2/146; 2/149

[58] Field of Search ..... 2/144, 145, 146, 148, 2/150, 152 R, 153, 155, 149, 243 R, 243 A

[56] References Cited

U.S. PATENT DOCUMENTS

| | | | |
|---|---|---|---|
| 1,151,065 | 8/1915 | Terry | 2/153 |
| 1,830,039 | 11/1931 | Rosicky | 2/150 |
| 1,906,120 | 4/1933 | Waltz | 2/146 |
| 1,990,167 | 2/1935 | Cloke | 2/146 |
| 2,103,094 | 12/1937 | Scharlin | 2/150 |
| 2,172,849 | 9/1939 | Peters | 2/150 |
| 2,369,442 | 2/1945 | Davis | 2/146 |
| 2,679,050 | 5/1954 | Dzus | 2/146 |
| 3,264,654 | 8/1966 | Woronowicz et al. | 2/146 |
| 3,276,037 | 10/1966 | Englehaupt | 2/146 |
| 3,953,894 | 5/1976 | Aron | 2/146 |

*Primary Examiner*—Clifford D. Crowder
*Assistant Examiner*—Jeanette E. Chapman
*Attorney, Agent, or Firm*—Elliot B. Aronson

[57] ABSTRACT

A necktie and separate pre-formed knot that may be slid into position onto the necktie body and securely maintained in position without slipping. A knot is formed from a generally trapezoidally shaped assembly that is first folded over on itself so that its angled ends overlie one another. The overlying angled ends are secured to one another along a seam offset from the edges of the angled ends so as to define a margin or wing portion between the seam and the edges of the angled ends. The resulting folded and closed assembly is then turned inside out to form the finished knot. The wing portion protrudes into the central opening of the knot to engage the necktie body and hold the knot securely in place on the necktie body. The trapezoidally shaped assembly from which the knot is formed is itself formed of a foundation member and a fabric wrapped around the foundation member. Knots of different styles are described emulating, for example, the common four-in-hand, half-windsor and full-windsor knots. A necktie body for use with the above knot is formed with one or more longitudinal pleats in the neck section which gather together the material so that the neck section is at least somewhat narrower than the front section of the tie. Pleated or gathered in this manner, the material forms a dimple at the top portion of the front section of the tie, where the neck and front sections meet. When the knot is slid in place on the tie body around a wearer's neck, this dimple extends from under the knot to emulate the dimple formed when a necktie is tied in conventional manner.

8 Claims, 6 Drawing Sheets

NECKTIE WITH PRE-FORMED KNOT

BACKGROUND OF THE INVENTION

The present invention relates to neckties and in particular to neckties with pre-formed knots.

Neckties having pre-formed knots have long been available as a substitute for the conventional necktie, which must be tied anew around the user's neck each time the tie is to be worn. Known pre-formed neckties, however, are subjected to a variety of deficiencies. Some may not reproduce the appearance of a hand-tied knot very well and thus look artificial. Some may be worn only with a closed collar, and thus are not adaptable to women's tie fashions which are often worn with an open collar. Others require a heavier weight fabric for proper appearance and thus cannot be formed of the finer silk fabrics that are often used for neckties. Yet others are costly to manufacture.

SUMMARY OF THE INVENTION

The present invention fills a need for a pre-tied necktie that is realistic in appearance and that is adaptable for both men's and women's fashions. A tie according to the invention may be used with a variety of knot styles. The knot may be positioned in an uppermost position at the neck for use with a closed collar or may be slid to a lower position for use with an open collar. Under normal conditions of wear, however, the knot of the present invention will not slip while being worn. Moreover, the present necktie is economical to manufacture.

Briefly, a pre-formed necktie knot according to the invention is formed from a generally trapezoidally shaped assembly that is first folded over on itself so that its angled ends overlie one another, the overlying angled ends are then secured to one another along a seam offset from the edges of the angled ends, and the resulting folded and closed assembly is then turned inside out. A knot formed in this manner has a central opening through which the ends of the necktie body are inserted when the tie is worn around the user's neck and also has a portion, provided by the margin between the seam and the edges of the angled ends and referred to as a wing portion, that protrudes into the central opening to engage the necktie body and hold the knot securely in place on the necktie body. The trapezoidally shaped assembly from which the knot is formed is itself formed of a foundation member and a fabric wrapped around the foundation member. Knots of different styles, for example, emulating the common four-in-hand, half-windsor and full-windsor knots, may be formed by appropriately selecting the shape and size of the foundation member and by appropriately wrapping the fabric around the foundation member.

A necktie body for use with the above knot according to the invention is formed with one or more longitudinal pleats in the neck section which gather together the material so that the neck section is at least somewhat narrower than the front section of the tie. Pleated or gathered in this manner, the material forms a dimple at the top portion of the front section of the tie, where the neck and front sections meet. When the knot is slid in place on the tie body around a wearer's neck, this dimple extends from under the knot to emulate the dimple formed when a necktie is tied in conventional manner.

A further understanding and appreciation of the nature and advantages of the invention will be gained by reference to the remaining portion of the specification and to the attached drawings.

DETAILED DESCRIPTION OF ILLUSTRATIVE EMBODIMENTS

Figure 1:
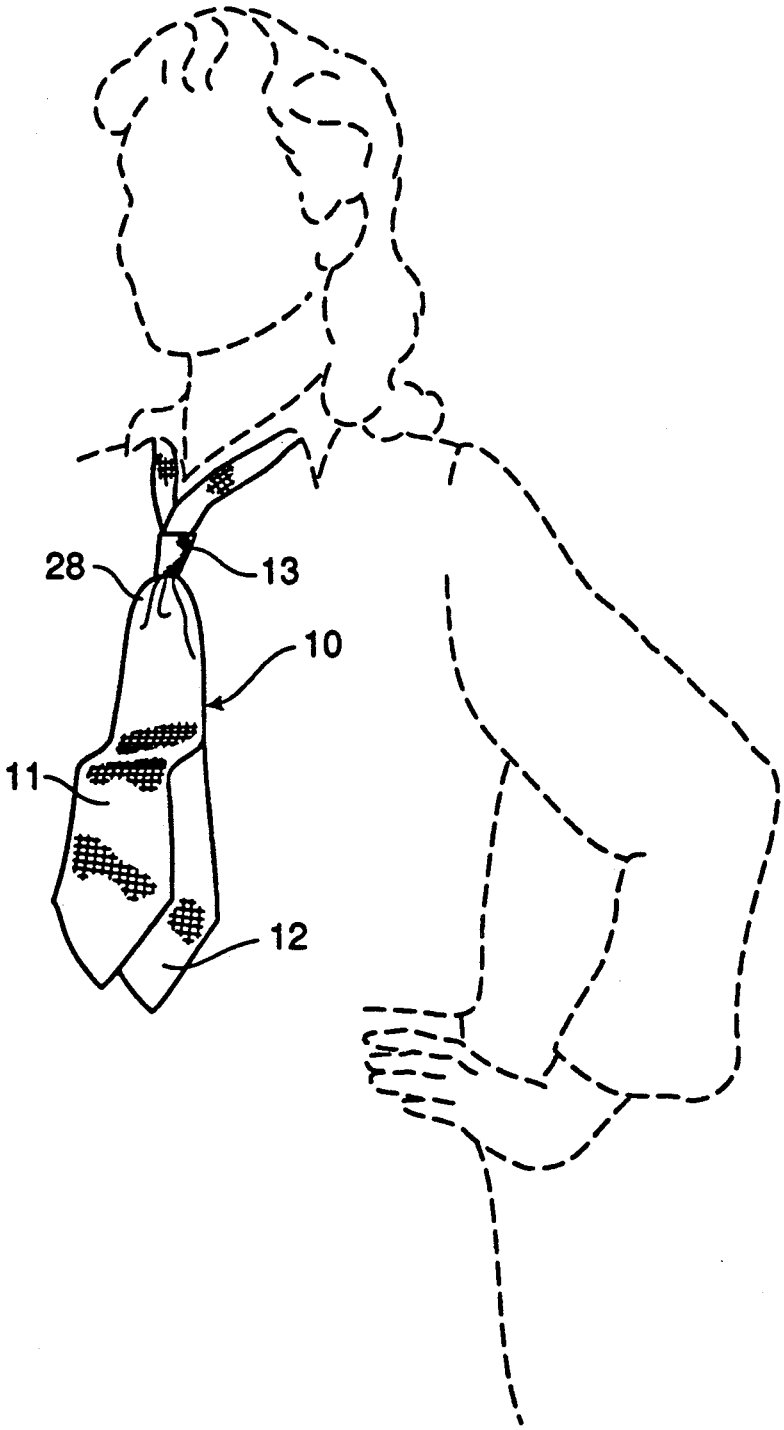
FIG. 1 is a perspective view of a person wearing a necktie according to the invention.

FIG. 1 shows a person wearing a necktie, which consists of the necktie body, indicated generally at 10, having an outer front or top section 11, which has been raised in FIG. 1 to reveal the underlying rear or bottom section 12 usually hidden by the top section. The necktie body is retained in position around the wearer's neck by the knot 13. In the present invention necktie body 10 and knot 13 constitute separate constructions, although this is not generally discernable when the necktie and knot are worn as illustrated in FIG. 1.

Figure 2:
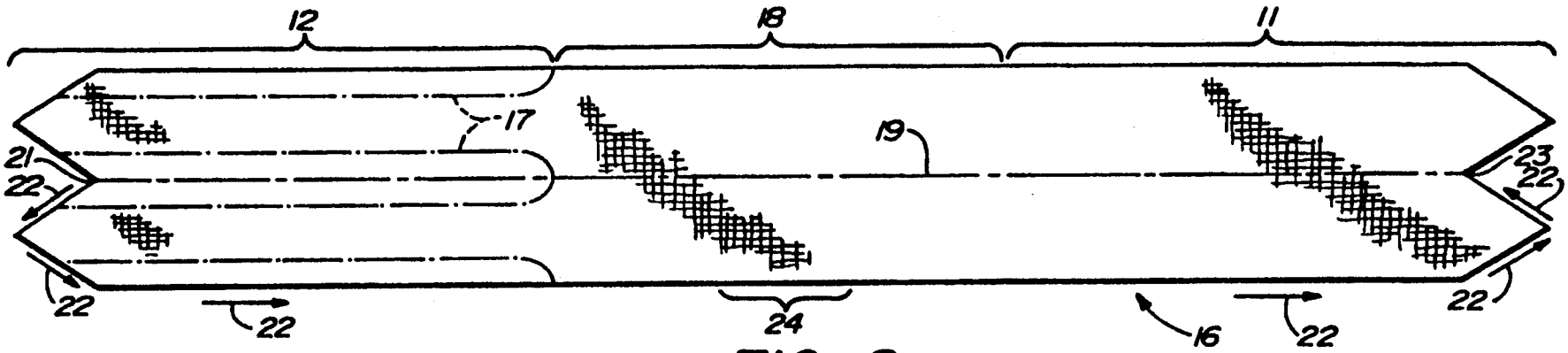
FIG. 2 shows a pattern for the body of a necktie according to the invention with an alternative embodiment shown in phantom.

Necktie body 10 is formed from a pattern 16 such as shown in FIG. 2. The solid lines in FIG. 2 show a first embodiment of a tie pattern and the phantom lines 17 show another, as will be explained below. The portions of pattern 16 forming the front and back sections of the tie body are indicated at 11 and 12, respectively, which are joined by an intermediate neck section 18. As illustrated in FIG. 2 the tie pattern exhibits a bilateral symmetry about the centerline 19. To form the tie body, pattern 16 is folded along centerline 19 say by folding the top half over the bottom half. The two overlying halves are then stitched together along their overlying edges by starting at one end of the fold line, e.g., at position 21 and sewing in the direction of arrows 22 to the other end of the fold line at position 23. In sewing the two halves of the folded pattern together, a short length of the overlying edges is left unsewn as indicated at 24. The folded and sewn pattern is then turned inside out through the unsewn gap 24. In this manner the seam holding the two halves of the pattern together is completely hidden from view.

Figure 3:
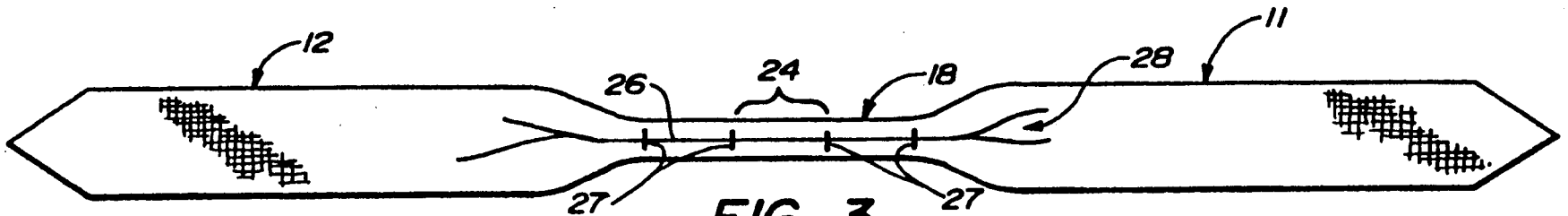
FIG. 3 is a plan view of the assembled necktie body of FIG. 2.

After the sewn pattern is turned inside out, at least one longitudinal pleat or tuck 26 is formed in neck section 18 and is secured by cross stitching 27. Pleat 26 serves to gather the fabric material of the neck section together so that the neck section is narrower than the front section as is customary to assure that the neck section will remain hidden under a shirt collar when worn. Men's ties will typically be formed with a single pleat as shown in FIG. 3. Alternative styles for women's ties, however, may be created with more than one pleat.

Pleat 26 runs along the neck section and terminates at one end where the neck section and front section meet, which is the position occupied by knot 13 when the tie is worn. Formed in this manner, pleat 26 serves to define a dimple 28 in the fabric of the tie body at the end of the pleat extending out from under the knot. (See FIGS. 1 and 3.) In a conventional hand-tied necktie a dimple appears naturally from under the knot. In the present invention the dimple is pre-sewn into the tie body. This dimple is necessary to give the tie a realistic, natural appearance.

The necktie body formed in the manner just described will have a bottom section 12 of the same width as the top section 11. Such a style is common in women's ties and can serve equally well for men's ties. This construction even has the advantage that either end may be placed on top of the other so that if a first "front" section becomes soiled say in the course of a day, the front and rear sections may be reversed so as to cover the soiled portion for the remainder of the day. The look of the traditional men's tie having a back section 12 narrower than the front section 11 can nevertheless be reproduced in the present invention, for example, by using a tie body pattern 16 with a bottom section 12 having the alternative shape 17 shown in phantom in FIG. 2. Those skilled in the art of sewing will recognize that a tie body with narrow bottom section 12 may be formed in other ways, for example, by continuing the pleat 26 into bottom section 12 provided that this does not unduly disturb any decorative pattern on the fabric.

The present construction of the tie body has certain advantages over the traditional construction. Men's ties have traditionally employed an interfacing material between two layers of the tie fabric. The interfacing and the tie fabric are both cut on a bias, which serves to hold the tie's shape. The interfacing material may be avoided in the present construction, however, because the permanently sewn pleat helps the tie to keep its shape. The lack of any need for interfacing material in turn reduces the cost of manufacture because it saves on both material and labor. Traditional construction may use up to four pieces of interfacing material of different shapes placed in different areas in the tie and often calls for hand-sewing because machine-sewing may pull the material too tightly and cause a pucker on the interfacing. The one-piece construction of tie body in the present invention saves on fabric and is simpler, hence less expensive, to sew because a tie body can be sewn with only one seam interrupted only for the pocket 24 with no extra labor-consuming steps for handling the interfacing.

Figure 4:
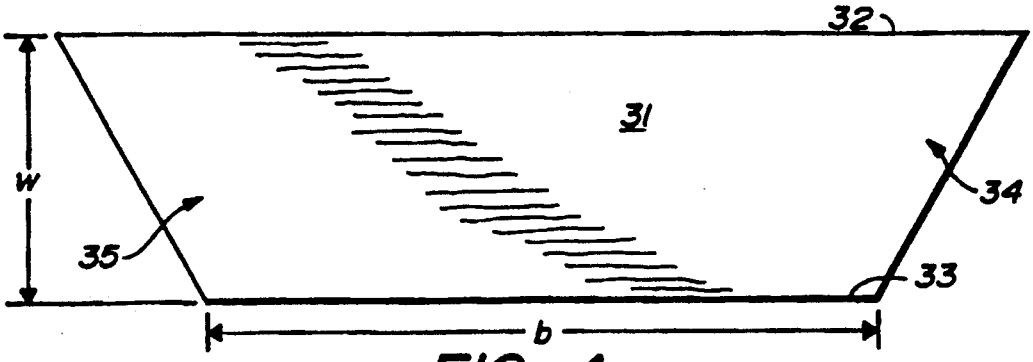
FIG. 4 is a side view of a foundation member for a four-in-hand knot and for a full Windsor knot according to the invention.
Figure 6A:
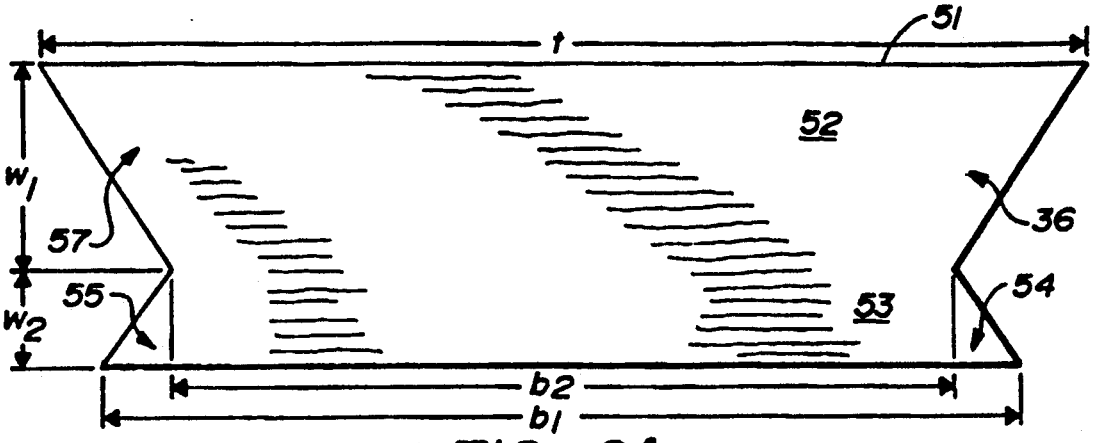
FIG. 6A is a side view of a foundation member for a half Windsor knot according to the invention.

Knot 13 is pre-formed separately from tie body 10 from a specially prepared intermediate knot assembly. The intermediate knot assembly comprises a foundation member such as illustrated in FIGS. 4 and 6A which is covered with fabric material in a manner described below. Several different styles of knot may be formed from different knot assemblies. Three different such knot styles are described below, which emulate the traditional four-in-hand knot, the half-Windsor knot, and the full-Windsor knot.

A knot emulating the traditional four-in-hand knot will now be described with reference to FIGS. 4 and 5A–5C. A suitable foundation member 31 for use in the four-in-hand knot is shown in FIG. 4. Foundation member 31 is of a generally trapezoidal shape having two generally parallel edges 32 and 33 and two angled end portions 34 and 35. For the four-in-hand knot the foundation member has a top edge 32 of length t of about 6.5 inches, a bottom edge 33 of length b about 4 inches, and a width w about 1.5 inches.

The foundation member serves to give body to the knot. It must be of sufficiently heavy weight to provide the desired body; it must also have sufficient flexibility and suppleness that the knot when worn will have the appearance of naturally folded fabric within the knot structure; yet the foundation member must also be sufficiently flexible and stretchable to permit the knot assembly to be turned inside out without disrupting the fabric covering. An evenly formed material with no ribbing or other such intermittent structure and having a degree of stretchability has been found most suitable. Otherwise the knot assembly will not have sufficient smoothness to be readily turned inside out as described below. Moreover, such other intermittent structure can make the knot stiff, hence, uncomfortable and unnatural looking. In general, the foundation material must be flexible and stretchable while at the same time able to hold its shape. An elastomeric material such as corset elastic has been found suitable for the foundation member. Those skilled in the art will readily be able to determine the suitability of alternate foundation materials through trial and error.

Figure 5A:
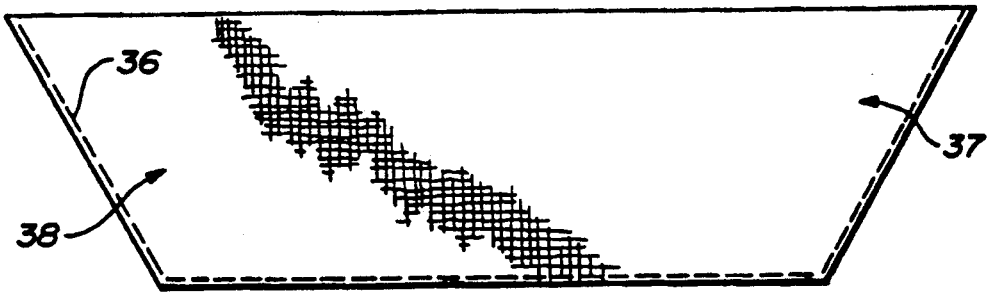
FIG. 5A is a side view of a four-in-hand knot in a first intermediate stage of assembly.
Figure 5B:
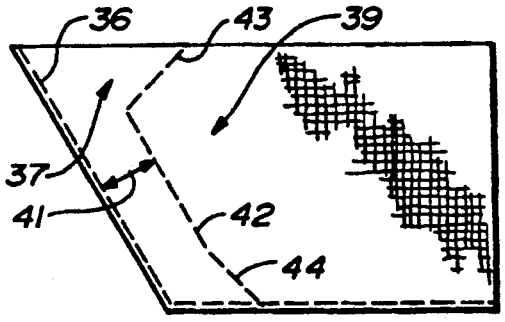
FIG. 5B is a side view of a four-in-hand knot in a second intermediate stage of assembly.

To form the intermediate knot assembly the fabric material selected for the knot is wrapped around foundation member 31 so as to follow the generally trapezoidal shape of the foundation member. FIG. 5A shows the fabric-wrapped foundation member. The fabric material is folded over the top edge 32, and the raw ends of the fabric are folded and tucked under at the edges 33, 34 and 35 so that no rough edges show. The tucked edges are then sewn along seam line 36 as indicated at FIG. 5A. The fabric is preferably left unsewn along the top edge (i.e., the longer edge) as this is the edge that will be exposed to view in the finished knot. The fabric-wrapped foundation member is then folded in half so that the angled ends 37 and 38 of the generally trapezoidal shape overlie one another as shown in FIG. 5B. The overlying ends 37 and 38 are then secured to one another along seam 39 so that the knot assembly forms a closed loop.

Seam 39 is important because it provides a measure of structural integrity to the knot. At least a portion of seam 39 is spaced apart from the overlying edges of the angled ends 37 and 38 of the fabric-wrapped foundation member such as indicated by the spacing 41 in FIG. 5B. In the four-in-hand knot seam 39 may be formed with a midportion 42 generally parallel to the overlying edges of the angled ends 37 and 38, which serves to define the spacing 41. Seam 39 also includes endportions 43 and 44, which extend away from the overlying angled ends and toward the adjacent parallel edges of the folded fabric-wrapped foundation member. Endportions 43 and 44 of seam 39 also space the ends of the seam apart from the edges of the overlying angled ends.

Figure 5C:
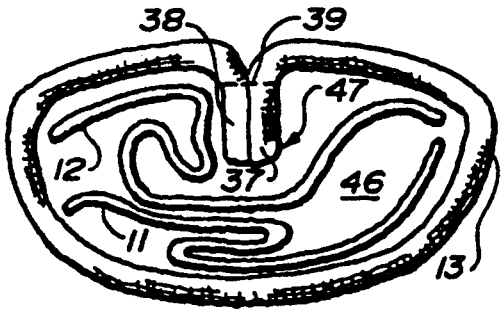
FIG. 5C is a plan view of an assembled four-in-hand knot according to the invention, showing a diagrammatic representation of a tie body within the knot.

The pre-formed four-in-hand knot is then formed by turning the sewn intermediate knot assembly inside out through the loop formed by the folded-over fabric-wrapped foundation member and seam 39. FIG. 5C shows a plan view of the knot 13 so formed. The inverted knot assembly forms a central opening 46 through which the front and back sections of the necktie body extend. The margin of material lying between the overlying edges of the angled ends 37 and 38 and seam 39 forms a wing portion 47 that protrudes into the central opening 46 and frictionally engages the fabric material forming the rear section 12 and indirectly engages the front section 11 of the necktie body. The angled configuration of endportions 43 and 44 of seam 39 with respect to midportion 42 provides a measure of structural integrity to wing portion 47 so that it will tend not to collapse at its ends as the knot is slid into position on the tie body.

A knot emulating the traditional half-Windsor knot will now be described with reference to FIGS. 6A–6C. A suitable foundation member 51 for use in the half-Windsor knot is shown in FIG. 6A. Foundation member 51 has an upper portion 52 of a generally trapezoidal shape and a lower portion 53 defining lateral projections 54 and 55 at the lower angled ends 56 and 57 of the trapezoidal upper portion. The trapezoidal upper portion has a width w1 greater than the width w2 of the lower portion so that the bulk of the vertical extent of foundation member 51 is defined by the upper portion 52. For the half-Windsor knot the foundation member has a top edge of length t about 6.5 inches and a bottom edge of length b1 about 4 inches. The upper portion width w1 is about 1.5 inches and the lower portion width w2 is about 0.5 inches. The base b2 of the upper portion trapezoidal shape is about 3.25 inches.

Figure 6B:
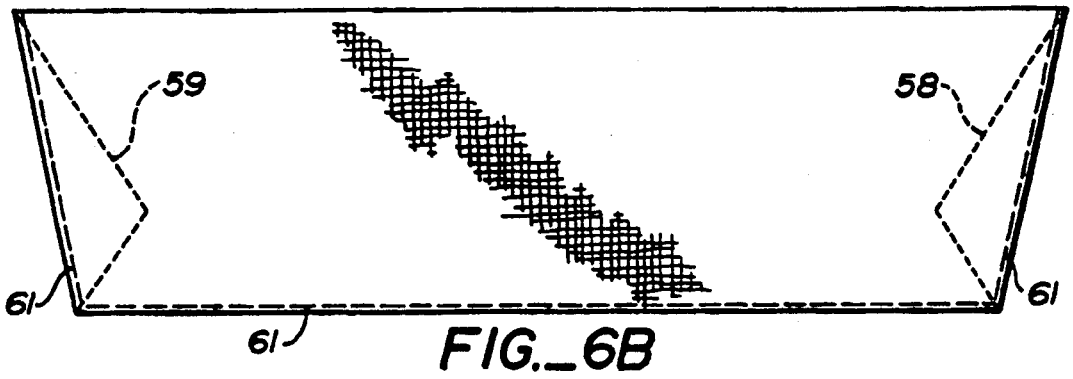
FIG. 6B is a side view of a half Windsor knot in a first intermediate stage of assembly.
Figure 6C:
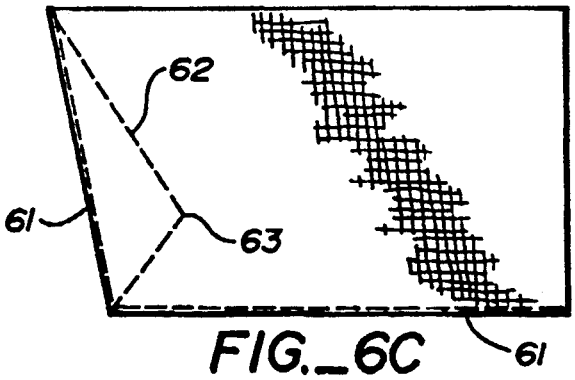
FIG. 6C is a side view of a half Windsor knot in a second intermediate stage of assembly.

To form the half-Windsor intermediate knot assembly, the fabric material is wrapped around foundation member 51 to form a generally trapezoidal shape as illustrated in FIG. 6B resulting in the same general shape as the fabric-wrapped foundation member of FIG. 5A for the four-in-hand knot. The fabric need not follow the angulated contour, shown in phantom at 58 and 59, of the ends 54, 56 and 55, 57 of the underlying foundation member. The vertices of the resulting trapezoidal shape are defined by the lateral extremities of the upper portion 52 and lower portion projections 54 and 55. As in the four-in-hand knot the fabric material is folded over the top edge, and the raw ends of the fabric are folded and tucked under at the sides and bottom edges of the foundation member so that no rough edges show. The tucked edges are then sewn along seam line 61 as indicated in FIG. 6B. As before, the fabric is preferably left unsewn along the top (longer) edge. The fabric-wrapped foundation member is then folded in half so that the angled ends of the generally trapezoidal shape overlie one another as shown in FIG. 6C. The overlying ends are then secured to one another along seam 62, which generally follows the overlying contours 58 and 59 of the angulated ends of the foundation member. In this concave form of seam the midregion of the seam, and in particular the apex 63 of the angulated seam, defines the spacing of the seam from the outer edges and consequently determines the width of the wing portion in the final knot.

When the half-Windsor knot assembly is turned inside out it produces a longer, fuller-looking knot reminiscent of a hand-tied half-Windsor. Because the knot is longer, it has a greater tendency to collapse along its vertical length. The angulated shape of foundation member 51 with its extra lateral projections at the bottom and the concave shape of seam 62 provide the extra integrity needed for the knot to maintain its shape.

Figure 7A:
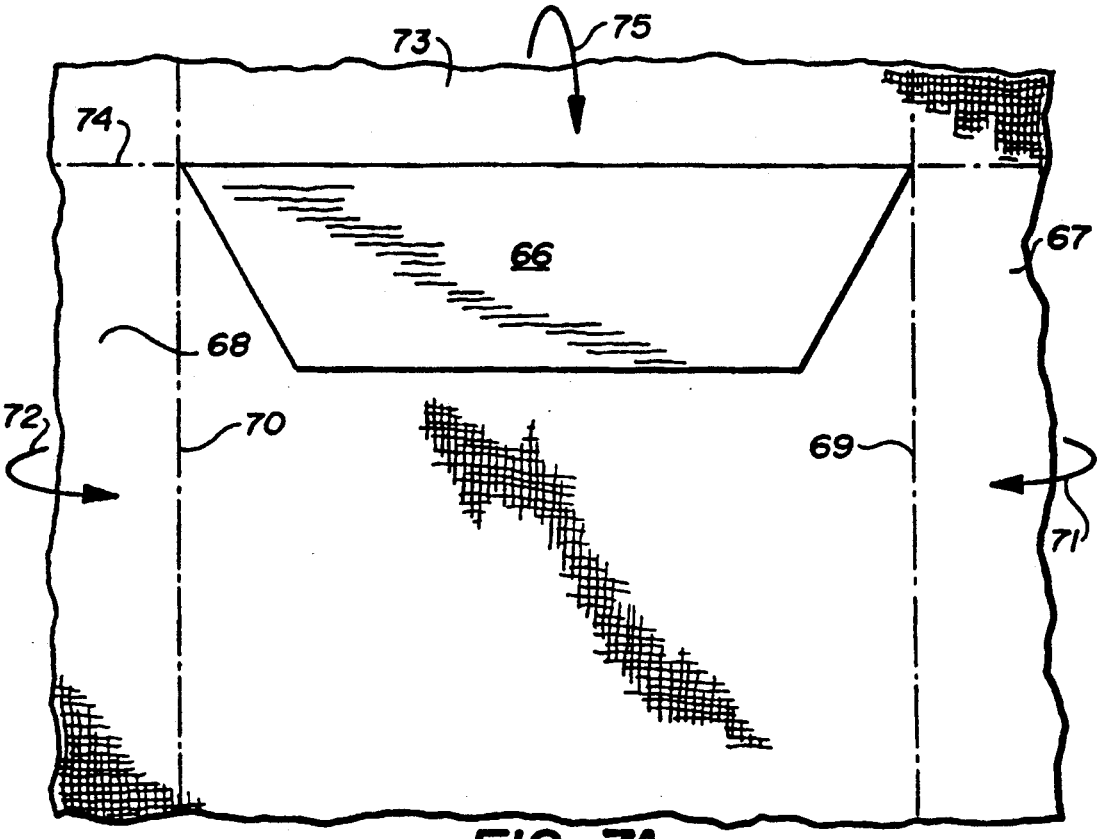
FIGS. 7A–7E show a sequence of intermediate stages in the assembly of a full Windsor knot according to the invention.
Figure 7B:
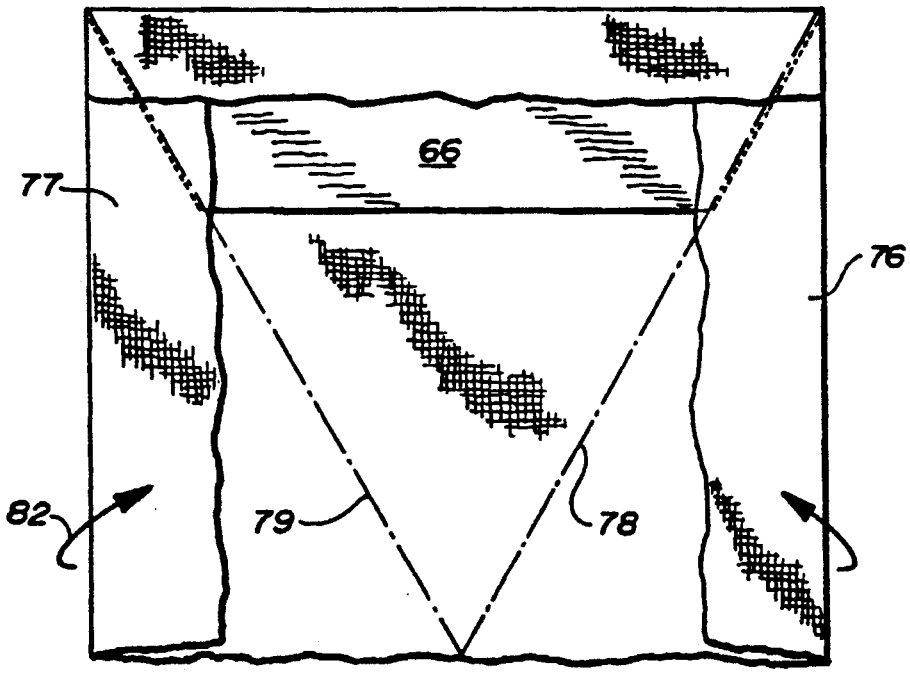
Figure 7C:
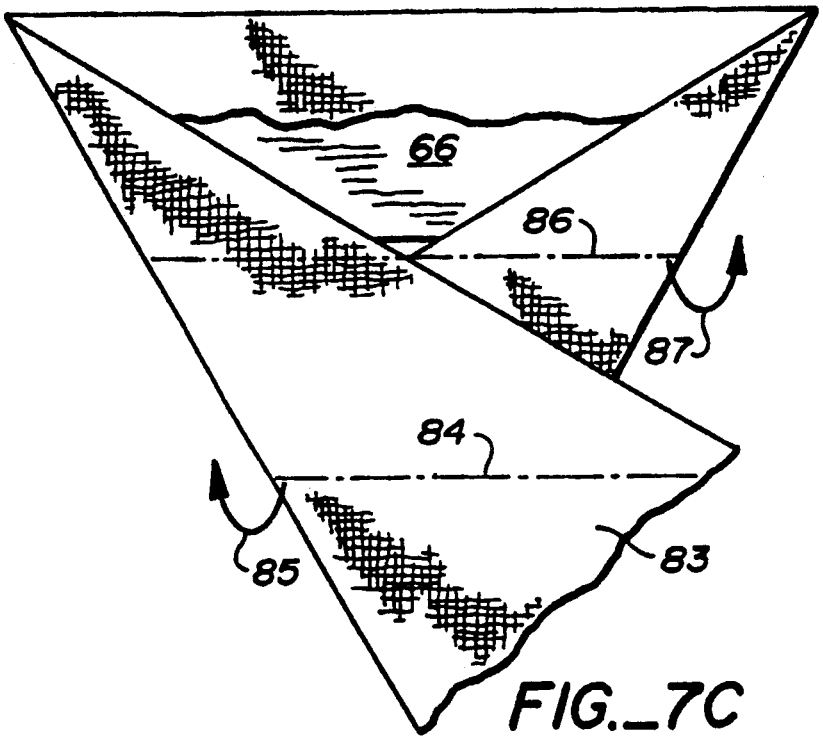
Figure 7D:
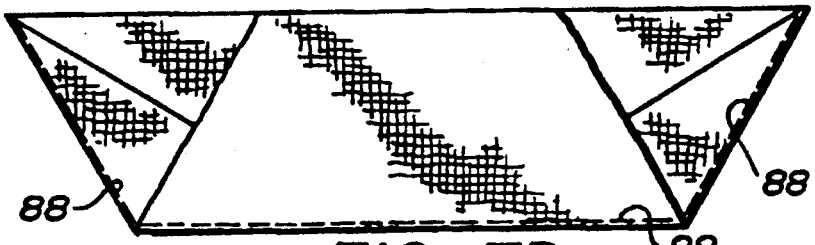
Figure 7E:
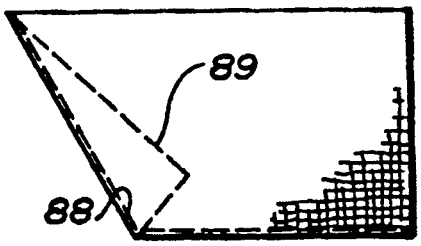

A knot emulating the traditional full-Windsor knot will now be described with reference to FIGS. 7A–7E. The full-Windsor knot employs a foundation member of the same general shape as the four-in-hand knot shown in FIG. 4, but with a greater width w of about 2 inches. The main difference is in the manner in which the fabric is wrapped around the foundation member. FIGS. 7A–7D show the steps for wrapping the full-Windsor foundation member. In FIG. 7A foundation member 66 is placed on a length of fabric near the top. The sides of the fabric 67 and 68 are first folded over foundation member 66 along fold lines 69 and 70 as indicated by arrows 71 and 72, and the top margin of fabric 73 is folded over foundation member 66 along fold line 74. The intermediate result is illustrated in FIG. 7B. The fabric wings 76 and 77 are then folded along fold lines 78 and 79 as indicated by arrows 81 and 82. The result is shown in FIG. 7C. The fabric wing 83 is then folded first along fold line 84 as indicated by arrow 85, and then along fold line 86 as indicated by arrow 87. The widths of the folds are selected so that the fold along fold line 84 is finally positioned along the top of the foundation member. Thus, at the top of the foundation member two folds will be seen. The first is the along fold line 74 indicated by arrow 75 in FIG. 7A, and the second is the fold along fold line 84. The resulting fabric-wrapped foundation member is shown in FIG. 7D. The wrapped foundation member is then seamed along the lower edges along seam 88, and is folded in half as before so that the angled ends overlie one another. See FIG. 7E. The overlying ends are then secured to one another along seam 89 that has the same general concave angulated shape as used for the half-Windsor knot. The resulting knot assembly is then turned inside out as before to form the final knot. The multiply folded construction employed for the full-Windsor produces a full-looking knot exhibiting an even fullness across its breadth and revealing an even amount of material across the top.

The above descriptions and drawings disclose illustrative embodiments of the invention. Given the benefit of this disclosure, those skilled in the art will appreciate that various modifications, alternate constructions, and equivalents may also be employed to achieve the advantages of the invention. Therefore, the invention is not to be limited to the above description and illustrations, but is defined by the appended claims.

What is claimed is:

1. A necktie with pre-formed knot comprising:

a fabric necktie body having a front section, a neck section, and a bottom section, wherein said neck section is narrower than said front section and has at least one longitudinal pleat pre-formed therein and positioned so that an end of said pleat forms a fabric dimple extending to said front section beneath the pre-formed knot when worn around a user's neck; and said pre-formed knot having a central opening for receiving said necktie body when worn around a wearer's neck and having a wing portion protruding into said central opening for frictionally engaging said necktie body, said pre-formed knot being formed by the process of turning inside out a knot assembly forming a closed band, said knot assembly comprising:

a foundation member of elastomeric material;

fabric material wrapped around said foundation member to form a generally trapezoidal shape having two generally parallel edges and two angled ends;

said fabric-wrapped foundation member being folded over so that said angled ends overlie one another;

wherein said overlying angled ends are secured to one another along a seam to form said closed band; said seam having a central portion and other portions; and wherein at least said central portion of said seam is spaced apart from the edges of said overlying angled ends and wherein a distance of the seam from said ends at said central portion is different than a distance of the seam from said ends at said other portions of said seam; so as to define said wing portion, wherein said central portion of said seam is spaced apart from said edges of said overlying angled ends by a distance causing said wing portion to protrude sufficiently into said central opening of said knot when said knot assembly is turned inside out and to frictionally engage said necktie body sufficiently to maintain said preformed knot in position on said necktie body when subjected to the dislodging forces normally encountered when worn around the user's neck.

2. The necktie and knot of claim 1 wherein said foundation member is of a generally trapezoidal shape and said other portions of said seam comprise two end portions, said seam central portion being generally parallel to said overlying angled ends and said seam endportions extending generally away from said overlying angled ends and generally toward the respective adjacent parallel edges of said fabric-wrapped foundation member.

3. The necktie and knot of claim 1 wherein said foundation member is of a generally trapezoidal shape and said seam has a generally angular shape including an apex spaced apart from the edges of said overlying angled ends and positioned in the lower portion of said fabric-wrapped foundation member, said seam running from the upper lateral extremity of said overlying angled ends inwardly toward said apex and then outwardly to the lower lateral extremity of said overlying angled ends.

4. The necktie and knot of claim 1 wherein said fabric material is wrapped around said foundation member so as to expose only a single fold of material at the longer of said two generally parallel edges.

5. The necktie and knot of claim 1 wherein said foundation member has an upper portion of generally trapezoidal shape and a lower portion having a width less than said upper portion and defining a lateral projection at each angled end of the upper portion, wherein the lateral extremities of said upper portion and of said lower portion projections define the vertices of the generally trapezoidal shape of said fabric-wrapped foundation member.

6. The necktie and knot of claim 5 wherein said seam has a generally angular shape including an apex spaced apart from the edges of said overlying angled ends and positioned in the lower portion of said fabric-wrapped foundation member, said seam running from the upper lateral extremity of said overlying angled ends inwardly toward the bottom of said upper portion and then outwardly to the lateral extremities of said lower portion projections.

7. The necktie and knot of claim 3 wherein said fabric material is folded over a longer of said two generally parallel edges and said material is further folded and disposed against said foundation member in such a manner as to present at least two folds of material at the longer of said two generally parallel edges.

8. The necktie and knot of claim 1 wherein said fabric material is folded over a longer of said two generally parallel edges and said material is further folded and disposed against said foundation member in such a manner as to present at least two folds of material at the longer of said two generally parallel edges.

* * * * *